US005297401A

United States Patent [19]

Hawco

[11] Patent Number: 5,297,401

[45] Date of Patent: Mar. 29, 1994

[54] ICE MAKER RESERVOIR APPARATUS

[76] Inventor: James H. Hawco, 110 St. Charles Blvd., Luling, La. 70070

[21] Appl. No.: 48,320

[22] Filed: Apr. 19, 1993

[51] Int. Cl.[5] ..... F25C 1/00

[52] U.S. Cl. ..... 62/340; 220/666; 222/386

[58] Field of Search ..... 62/340; 220/402, 403, 220/578, 666; 222/95, 386, 463

[56] References Cited

U.S. PATENT DOCUMENTS

| | | | |
|---|---|---|---|
| 2,318,928 | 5/1943 | Deighton | 222/95 |
| 2,382,536 | 8/1945 | Baxter | 220/402 X |
| 2,432,025 | 12/1947 | Lorenz | 220/666 X |
| 3,939,887 | 2/1976 | Scarnato | 220/666 |
| 4,027,499 | 6/1977 | Barto et al. | 62/340 |
| 4,136,802 | 1/1979 | Mascia et al. | 222/95 |
| 4,597,270 | 7/1986 | Kerr | 62/340 X |
| 4,817,824 | 4/1989 | LaFleur et al. | 220/402 X |
| 4,987,746 | 1/1991 | Roberts | 62/340 X |
| 5,069,364 | 12/1991 | McGill | 222/95 |
| 5,158,123 | 10/1992 | Senko | 220/666 X |

*Primary Examiner*—William E. Tapolcai
*Attorney, Agent, or Firm*—Leon Gilden

[57] ABSTRACT

A reservoir is arranged to permit directing of various fluids into an ice maker such as spring water and the like, wherein the reservoir includes a valve arranged to permit selective fluid flow into the ice maker or selectively into a further conduit for discharge of fluid from said reservoir.

4 Claims, 5 Drawing Sheets

FIG. 7
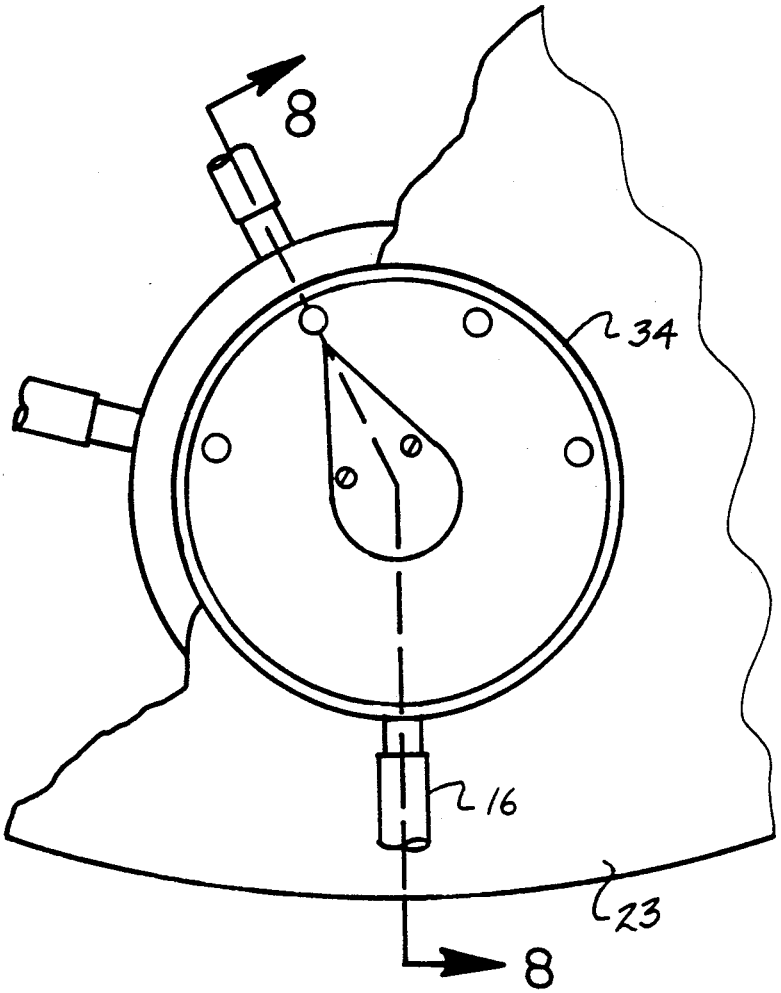
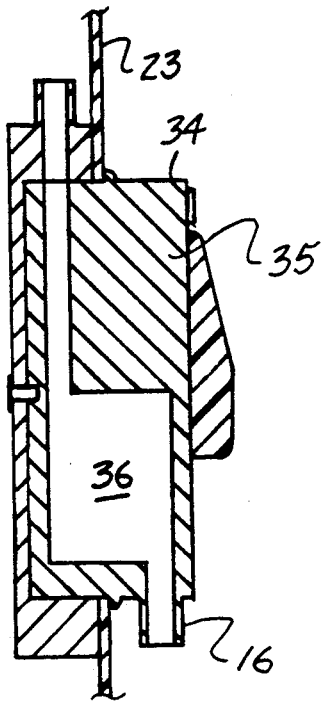
FIG. 8

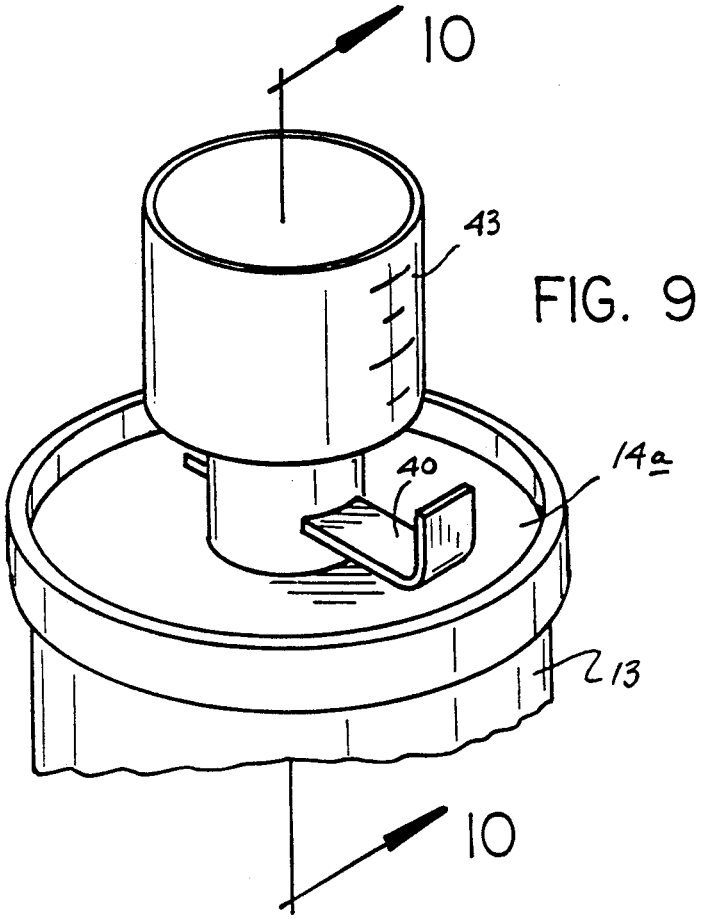
FIG. 9
FIG. 10
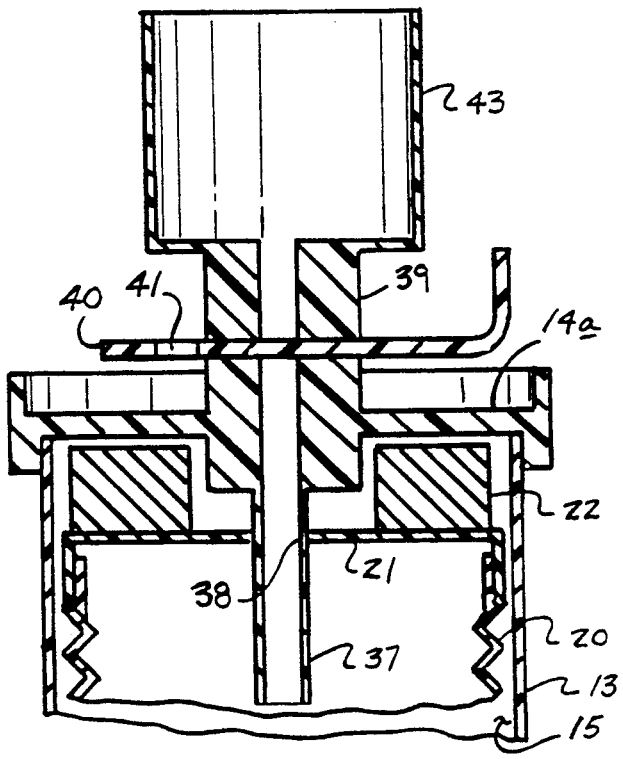

ICE MAKER RESERVOIR APPARATUS

BACKGROUND OF THE INVENTION

1. Field of the Invention

The field of invention relates to ice maker apparatus, and more particularly pertains to a new and improved ice maker reservoir apparatus wherein the same is arranged to control fluid characteristic into an ice maker.

2. Description of the Prior Art

Conventional ice makers typically direct fluid communication between household water supply and the associated ice maker, wherein the instant invention attempts to overcome such prior art by permitting use of a reservoir permitting selective fluid flow into an ice maker utilizing spring water, as well as various other fluids. U.S. Pat. No. 4,027,499 to Barto sets forth a reservoir directing fluid into an ice maker, with U.S. Pat. No. 4,941,902 permitting purified water flow into an ice maker.

SUMMARY OF THE INVENTION

In view of the foregoing disadvantages inherent in the known types of ice maker apparatus now present in the prior art, the present invention provides an ice maker reservoir apparatus wherein the same is arranged to direct and control fluid flow into an associated ice maker. As such, the general purpose of the present invention, which will be described subsequently in greater detail, is to provide a new and improved ice maker reservoir apparatus which has all the advantages of the prior art ice maker apparatus and none of the disadvantages.

To attain this, the present invention provides a reservoir arranged to permit directing of various fluids into an ice maker such as spring water and the like, wherein the reservoir includes a valve arranged to permit selective fluid flow into the ice maker or selectively into a further conduit for discharge of fluid from said reservoir.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ice maker reservoir apparatus which has all the advantages of the prior art ice maker apparatus and none of the disadvantages.

It is another object of the present invention to provide a new and improved ice maker reservoir apparatus which may be easily and efficiently manufactured and marketed.

It is a further object of the present invention to provide a new and improved ice maker reservoir apparatus which is of a durable and reliable construction.

An even further object of the present invention is to provide a new and improved ice maker reservoir apparatus which is susceptible of a low cost of manufacture with regard to both materials and labor, and which accordingly is then susceptible of low prices of sale to the consuming public, thereby making such ice maker reservoir apparatus economically available to the buying public.

Still yet another object of the present invention is to provide a new and improved ice maker reservoir apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic view of a further valve in operative association with the modified reservoir insert.

FIG. 8 is an orthographic view, taken along the lines 8—8 of FIG. 7 in the direction indicated by the arrows.

FIG. 9 is an isometric illustration of a modified canister lid structure.

FIG. 10 is an orthographic view, taken along the lines 10—10 of FIG. 9 in the direction indicated by the arrows.

DESCRIPTION OF THE PREFERRED EMBODIMENT

Figure 1:
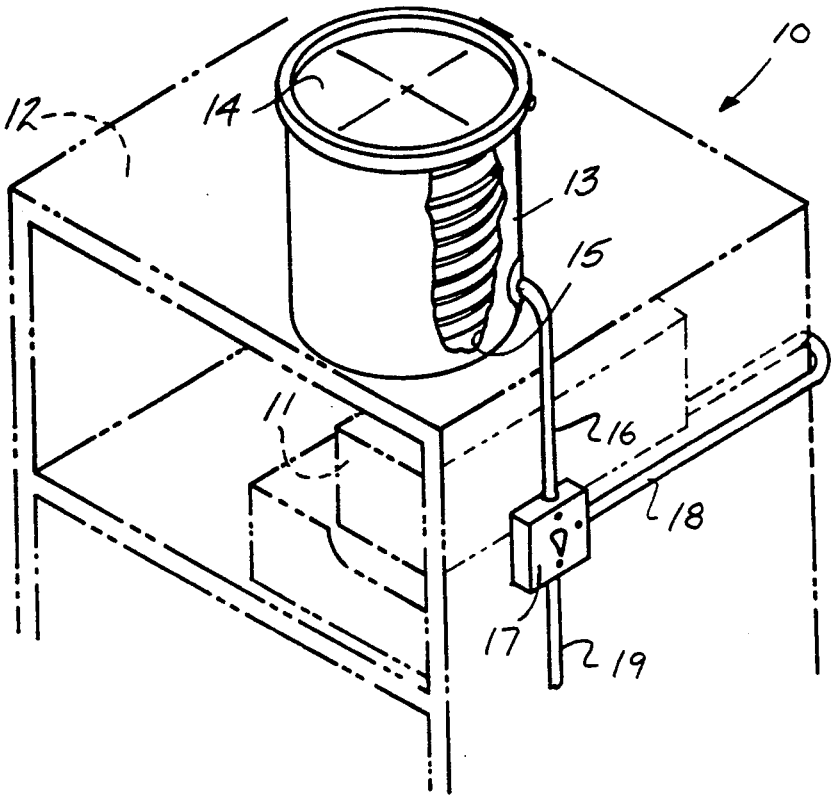
FIG. 1 is an isometric illustration of the invention.
Figure 2:
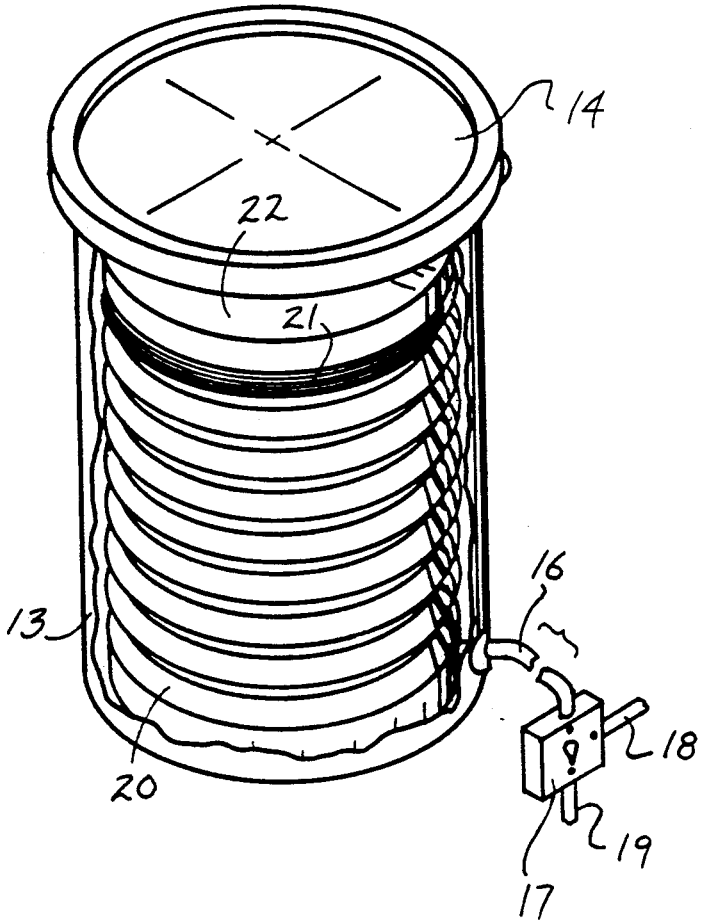
FIG. 2 is an enlarged isometric illustration of the reservoir structure.
Figure 3:
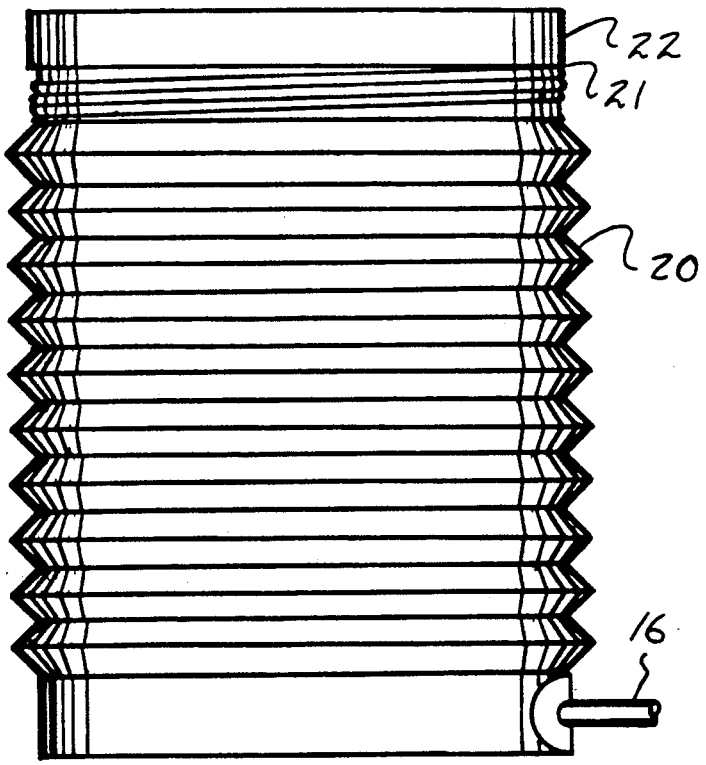
FIG. 3 is an orthographic side view of the reservoir structure.
Figure 4:
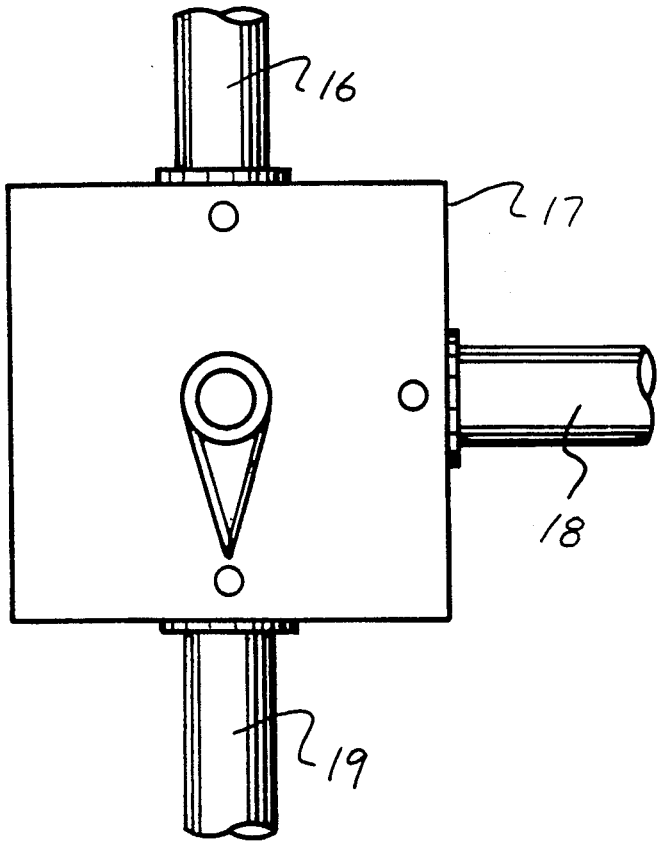
FIG. 4 is an orthographic view of the flow control valve.

With reference now to the drawings, and in particular to FIGS. 1 to 10 thereof, a new and improved ice maker reservoir apparatus embodying the principles and concepts of the present invention and generally designated by the reference numeral 10 will be described.

More specifically, the ice maker reservoir apparatus 10 of the instant invention is arranged in fluid communication with an ice maker 11 mounted within a freezer chamber of an associated refrigerator 12. The apparatus 10 includes a rigid canister 13 arranged for mounting upon the refrigerator 12, with the canister 13 having a canister lid 14 removably mounted relative to the canister 13 for access to the canister chamber 15. An accordion pleated fluid insert chamber 20 having accordion pleated side wall structure permits axial collapse of the insert chamber 20 within the canister chamber 15, with a first fluid conduit 16 in fluid communication adjacent a floor of the insert chamber 20, with the first fluid conduit 16 directed through the canister 13. The first fluid conduit 16 is directed into a valve member 17 to permit selective fluid flow to a second fluid conduit 18 that directs fluid flow to the ice maker 11, or selectively the valve member 17 permits fluid flow to a third fluid conduit 19 for permitting depletion of fluid within the insert chamber 20. An insert chamber lid 21 is arranged for mounting to an upper end portion of the insert chamber 20, with a lid weighted member 22 mounted upon the chamber lid 21 to pressurize the insert chamber 20 and enhance fluid flow therefrom.

Figure 5:
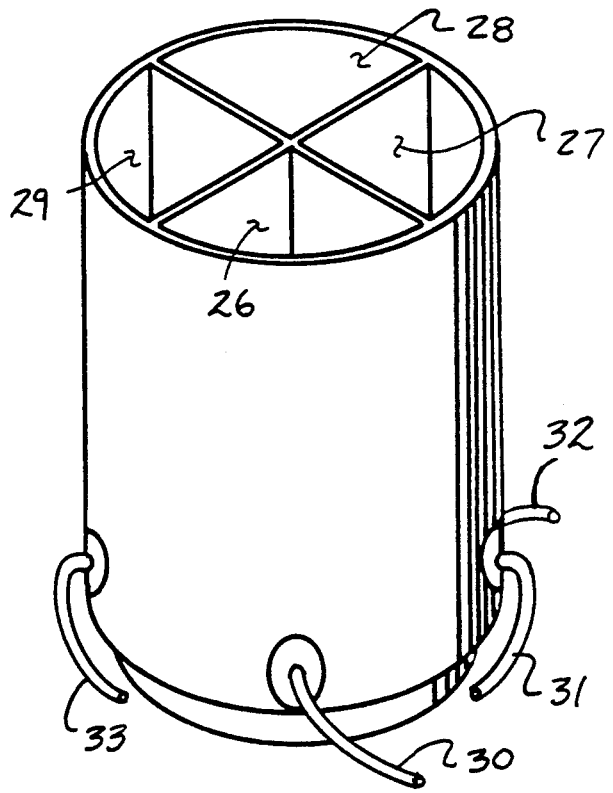
FIG. 5 is an isometric illustration of a modified reservoir insert.
Figure 6:
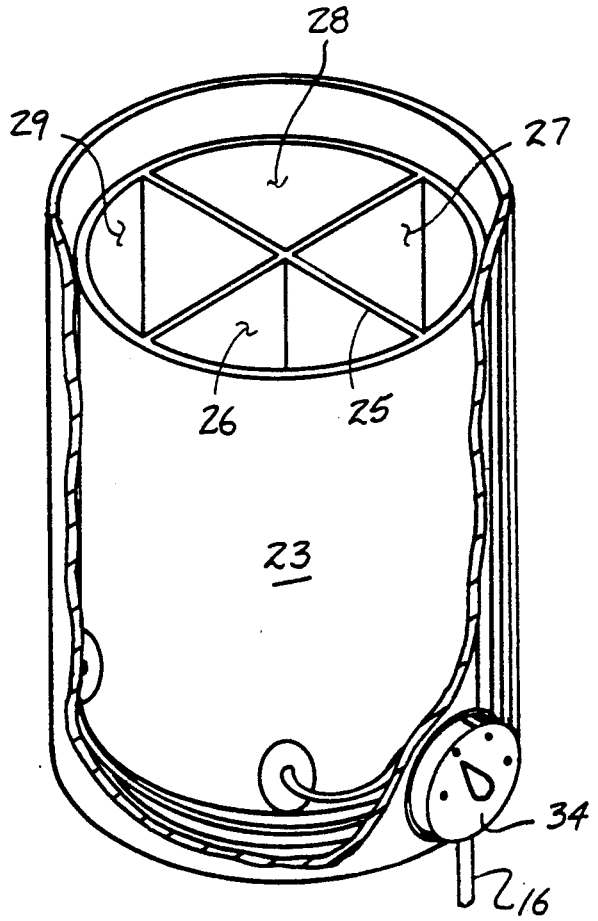
FIG. 6 is an isometric illustration of the reservoir insert mounted within the associated canister.

The FIGS. 5 and 6 indicate the use of a modified insert 23 having first and second intersecting partition walls 24 and 25 defining first, second, third, and fourth fluid chambers 26, 27, 28, and 29 respectively that have respective first, second, third, and fourth chamber conduits 30, 31, 32, and 33 directed therefrom, with the chamber conduits 30–33 directed into a canister valve 34 having a valve dial 35 and a valve dial chamber 36 permitting selective fluid flow from one of the respective fluid chambers 26–29 to the first fluid conduit 16.

The FIGS. 9 and 10 indicate the use of a modified lid 14*a*, wherein a canister lid fluid tube 37 is fixedly mounted to the modified lid 14*a* coaxially thereof and received through an insert chamber lid opening 28 of the insert chamber lid 21 to direct fluid flow into the insert chamber 20 from a transparent graduated cylinder 43 that is integrally mounted to a fluid tube rigid boss 39 effecting fluid communication between the canister lid fluid tube 37 and the transparent graduated cylinder 43 through a slide plate 40 reciprocatably mounted relative to the fluid tube rigid mounting boss 39. The slide plate 40 includes a slide plate opening 41 that is displaced from a first position displacing the opening relative to the fluid tube 37, wherein the slide plate 40 is slidably spaced to a second position, wherein the slide plate opening 41 is in fluid communication permitting fluid flow from the transparent graduated cylinder 43, through the fluid tube rigid mounting boss 39 and the associated canister lid fluid tube 37. In this manner, various additives, flavorings and the like may be added as desired into the insert chamber 20 without removal of the canister and insert chamber 20 from the canister.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ice maker reservoir apparatus, comprising in combination with a refrigerator, with the refrigerator including an ice maker, wherein the apparatus comprises, a rigid canister mounted upon the refrigerator, with the canister including a canister lid removably mounted to the canister, with the canister having a canister chamber, and an insert chamber mounted within the canister chamber, with the insert chamber collapsible, having an accordion pleated side wall, with the insert chamber including an insert chamber lid movably mounted relative to the insert chamber, and a first fluid conduit directed from the insert chamber in fluid communication with the insert chamber extending through the rigid canister, and a valve member, with the first fluid conduit in fluid communication with the valve member, and the valve member including a second fluid conduit in fluid communication with the valve member, and the ice maker, and a third fluid conduit, with the valve member permitting selective fluid communication between the first fluid conduit and the second fluid conduit and the first fluid conduit and third fluid conduit.

2. An apparatus as set forth in claim 1 wherein the insert chamber lid includes a lid weighted member fixedly mounted to the insert chamber lid for imparting collapse of the insert chamber and inserting pressure upon fluid positioned within the insert chamber.

3. An apparatus as set forth in claim 2 wherein the canister lid includes a fluid tube fixedly mounted to the canister lid, with the fluid tube having a fluid tube boss integrally mounting the fluid tube coaxially of the canister lid and the canister, with the insert chamber lid including a lid opening slidably receiving the canister lid fluid tube therethrough to permit selective fluid flow into the insert chamber through the canister lid fluid tube.

4. An apparatus as set forth in claim 3 wherein the mounting boss includes a transparent graduated cylinder mounted to the mounting boss in fluid communication with the canister lid fluid tube through the mounting boss, and a slide plate slidably directed through the mounting boss, with the slide plate having a slide plate opening, with the slide plate opening displaced relative to the fluid tube in a first position, and the slide plate opening aligned within the fluid tube in a second position within the mounting boss permitting selective fluid flow from the transparent and graduated cylinder into the fluid tube.

* * * * *